US009964377B2

(12) United States Patent
Marvin

(10) Patent No.: US 9,964,377 B2
(45) Date of Patent: May 8, 2018

(54) GUN BARREL CLEANING DEVICE

(71) Applicant: Claire C. Marvin, New Albany, OH (US)

(72) Inventor: Claire C. Marvin, New Albany, OH (US)

( * ) Notice: Subject to any disclaimer, the term of this patent is extended or adjusted under 35 U.S.C. 154(b) by 188 days.

(21) Appl. No.: 15/171,610

(22) Filed: Jun. 2, 2016

(65) Prior Publication Data

US 2016/0279685 A1 Sep. 29, 2016

Related U.S. Application Data

(63) Continuation-in-part of application No. 14/634,062, filed on Feb. 27, 2015, now abandoned, which is a continuation-in-part of application No. 14/224,126, filed on Mar. 25, 2014, now Pat. No. 9,377,265.

(60) Provisional application No. 61/911,779, filed on Dec. 4, 2013.

(51) Int. Cl.
*F41A 29/02* (2006.01)

(52) U.S. Cl.
CPC ..... *F41A 29/02* (2013.01)

(58) Field of Classification Search
CPC ..... F41A 29/02; B08B 9/00; B08B 9/02
USPC ..... 42/95
See application file for complete search history.

(56) References Cited

U.S. PATENT DOCUMENTS

| | | | | |
|---|---|---|---|---|
| 2,379,962 | A | 7/1945 | Hoerle | |
| 4,509,223 | A * | 4/1985 | Sipple | F41A 29/00 15/145 |
| 5,664,792 | A * | 9/1997 | Tseng | B23B 31/103 16/422 |
| 5,746,279 | A | 5/1998 | Havlinek et al. | |
| 5,934,000 | A | 8/1999 | Hayes, Sr. | |
| 8,448,370 | B2 | 5/2013 | Williams | |
| 2007/0051027 | A1 | 3/2007 | Stordal | |
| 2007/0261288 | A1 | 11/2007 | Perry et al. | |
| 2011/0209379 | A1 | 9/2011 | Williams | |
| 2013/0091753 | A1 | 4/2013 | Rogers et al. | |

* cited by examiner

*Primary Examiner* — Laura C Guidotti
(74) *Attorney, Agent, or Firm* — Standley Law Group LLP

(57) ABSTRACT

The present invention is an improvement to a gun barrel cleaning tool which enables a user to attach and remove gun barrel cleaning devices to a gun barrel cleaning rod by inserting a cleaning device into a recess formed in the cleaning rod whereupon a latch located in the recess engages a recess of the cleaning device to secure the cleaning device to the barrel cleaning rod.

18 Claims, 5 Drawing Sheets

GUN BARREL CLEANING DEVICE

CROSS-REFERENCE TO RELATED APPLICATION

This application is a continuation-in-part of U.S. patent application Ser. No. 14/634,062, filed Feb. 27, 2015 and also U.S. patent application Ser. No. 14/224,126, filed Mar. 25, 2014, which claims priority to U.S. Provisional Application No. 61/911,779, filed on Dec. 4, 2013. All of the above applications are incorporated by reference in their entirety as if fully recited herein.

TECHNICAL FIELD

Exemplary embodiments of the present invention relate generally to a device for cleaning debris from a gun barrel and a method of use for such a device.

BACKGROUND AND SUMMARY OF THE INVENTION

Firearms generally comprise a barrel structure, a chamber for housing a propellant, and a method of causing the propellant to propel a projectile down the barrel structure. The barrel structure is intended to guide the projectile toward its intended target. Frequently the inner surface of the barrel structure may be caused to have spiral indentations intended to cause the projectile to spin as it travels down the barrel. Such spin imparts stability and may result in a projectile that more consistently travels the path imparted by the barrel assembly. Other embodiments of firearms may have smooth inner barrel structure surfaces. Such other embodiments may rely on other methods of guiding a projectile towards its intended target. In order to guide a projectile towards its intended target, the inner surface of the barrel structure may have an inner diameter that is very close to the outer diameter of the projectile. This closeness in diameter is particularly critical when the barrel is designed to impart a spinning motion on the projectile.

Projectiles are frequently comprised of lead or other malleable material. In addition, some projectiles may have a coating or jacket material such as copper. As these projectiles travel down the barrel, the closeness in diameter causes the projectile to rub against the barrel assembly inner surface. The result may be traces of lead, copper, or other materials deposited from the projectile onto the barrel assembly.

Many embodiments of firearms rely on a propellant such as gunpowder or a similar chemical composition to propel a projectile down the barrel assembly. These designs may use a pressure sensitive substance to ignite the gunpowder in response to a user action such as pulling a trigger device. When the gunpowder ignites, it causes an explosion within a portion of the barrel assembly resulting in a rapidly expanding gas. This gas causes the projectile to travel rapidly down the barrel assembly and then continue on to the intended target. As the result of the exploding gunpowder, chemical particles may be deposited onto the inner surface of the barrel assembly.

As described above, traces of lead, copper, and other materials as well as chemical particles that result from the explosion of propellant may be deposited on the barrel assembly inner surface. Over time, such deposits may damage the surface of the gun barrel assembly and can interfere with the interface between the projectile and the gun barrel. Such interference may result in a reduction of the accuracy and performance of the firearm. As a result, the inner surface of the barrel assembly should be regularly cleaned to remove deposits.

Cleaning devices such as rods or cable devices are known in the art. Such devices commonly have removable cleaning devices. During an exemplary process for cleaning a barrel assembly these devices may be removed and replaced with devices for performing the various steps in the cleaning process. For example, a device for holding a cloth saturated with a cleaning solution may be caused to be attached to a cleaning rod. This cloth may then be pushed or pulled through the barrel assembly to cause cleaning solution to be deposited therein. The device for holding a cloth may be removed from the cleaning rod and replaced with a brush or scraper device to remove deposits from the barrel assembly. In this exemplary cleaning process, the brush or scraper may be removed and replaced with another device for holding a cloth that contains a corrosion inhibitor or lubricant material. As with the cleaning solution saturated cloth, this cloth containing a corrosion inhibitor or lubricant material may be pushed or pulled through the barrel assembly to deposit the corrosion inhibitor or lubricant onto the barrel assembly inner surface.

As described above, it is common for a cleaning process to be performed using multiple steps where each step may require a different device. A frequent problem during the performance of such steps is the recurring need to remove and replace the various devices used during the cleaning process. Known designs of cleaning devices, cleaning rods, and cleaning cables use a threaded interface between the rod or cable and the cleaning devices. Such a threaded interface requires that the user twist the cleaning device to engage the threaded interface and continue to twist until the threaded cleaning device is fully secured to the rod or cable. In order to accommodate longer gun barrel assemblies, sections of rod or cable are frequently required to be threaded together in a manner similar to what was described for attaching the cleaning device. In addition to being time consuming and tedious to assemble, threaded assemblies may be susceptible to cross-threading which may damage or destroy the threaded connection. Such a damaged connection may separate during use, resulting in a cleaning device becoming lodged in the barrel assembly or barrel damage from the unsecured cleaning rod or cable. Such a threaded assembly may also become unscrewed, even if the threaded section is not damaged. Again, this could result in the cleaning device becoming lodged in the barrel assembly. A known improvement to such a threaded connection is a connection that uses an enlarged end located on the cleaning device which is inserted into a keyhole shaped receiver located on a cleaning rod or cable. While such a connection eliminates the need to thread a cleaning device onto a barrel cleaning rod or cable, it only serves to secure the connection during a pulling motion. A pushing motion may cause this connection to release or become misaligned. The ability to push and pull a cleaning device through a gun barrel assembly allows for a more effective cleaning operation and eliminates the need to pull a cleaning device through the gun barrel assembly, disconnect the device from the cleaning rod or cable, reinsert the cleaning rod or cable, and reattach the cleaning device in order to perform the cleaning step a second time. With an attachment method that allows a user to apply a pushing and pulling motion to a cleaning device, that user may "scrub" the cleaning device back and forth in areas of the gun barrel assembly that require additional cleaning.

What is needed is a device to allow a user to quickly and easily change from one device to another during the cleaning process where such a device allows the user to both push and pull a cleaning device through a gun barrel assembly without unintended disconnection of the cleaning device from the cleaning rod or cable. Additionally, an embodiment of such a device may be fabricated using a reinforced plastic material that may be formed using an injection or similar molding process.

In an exemplary embodiment of the present invention, a hinged latch type interface between a cleaning rod or cable and cleaning device or additional segments of cleaning rod or cable may be formed using at least one engagement recess or groove which on a first section of the interface, partially or fully encircles a first shaft portion of the cleaning device or non-receiving portion of a cleaning rod and is inset radially from the first shaft portion of the cleaning device or non-receiving portion of the cleaning rod. A second section of the interface comprises a section of channel formed axially into an end portion of a cleaning rod or cable to receive the first shaft portion of the cleaning device or non-receiving portion of a cleaning rod. The second section of the interface may also comprise at least one hinged latch which may engage the engagement groove portion of the first shaft portion of the cleaning device or non-receiving portion of a cleaning rod as it is inserted into the first section of channel. In the described exemplary embodiment, the first shaft portion of the interface is positioned such that the engagement groove of the first shaft portion of the cleaning device enters the channel section of the second section of the interface. The first and second sections may be positioned such that the first shaft portion of the cleaning device makes contact with the end of the hinged latch. Once such contact is made, the first section may be inserted further into the second section so that the first shaft of the cleaning device is pressed further into the second section of the interface causing the hinged latch to move along the outer surface of the first shaft portion until it encounters the engagement recess or groove. When a trailing edge of the hinged latch reaches the beginning of the recess or groove of the first shaft portion of the cleaning device, the hinged latch may move downward such that the latch captures the engagement recess or groove, latching the cleaning device in place. When a user wishes to remove the cleaning device, that user may press an end of the hinged latch opposite from that portion of the hinged latch that is capturing the engagement groove of the cleaning device, causing the end of the hinged latch to rise above the edge of the engagement groove, releasing the groove and hence the cleaning device from the cleaning rod. In such an embodiment, the interface may be used to enable a user to connect a cleaning rod or cable to a cleaning device or an additional cleaning rod or cable by pushing such rod or cable and cleaning device together and partially twisting.

In an embodiment of the invention, a first shaft portion of the cleaning device may be tapered from a larger cross section where the first shaft portion meets the second shaft portion to a narrower cross section at the end of the first shaft portion farthest away from the second shaft portion of the cleaning device. Certain embodiments of the cleaning device may have an arcuate transition from the first to the second shaft portion to strengthen this connection point. Additionally, in certain embodiments of the invention, the first shaft portion may be rectangular in cross-section. In certain embodiments this rectangular shape will have equal or nearly equal sides (forming a square) while in other embodiments, the rectangular shape may have two sides that are shorter. In such an embodiment, the cleaning device will only fit into the rod in two orientations while an embodiment that is square will fit in four orientations. An engagement recess may be formed in two opposing faces of this rectangular cross section. In certain embodiments of the invention, the engagement recess may be formed to comprise a back bevel to more firmly engage a hinged latch portion which secures the cleaning device to the cleaning rod.

BRIEF DESCRIPTION OF THE DRAWINGS

In addition to the novel features and advantages mentioned above, other benefits will be readily apparent from the following descriptions of the drawings and exemplary embodiments.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

The present invention comprises an improved device for cleaning tubular barrel assemblies, including gun barrels. One skilled in the art will realize that such an invention may be used to clean other elongated tubular structures such as, but not limited to, pipes, musical instruments, chimneys, and laboratory instruments. A preferred embodiment of the present invention may utilize a molded plastic material as described herein but one ordinarily skilled in the art will understand that an equivalent device may be fabricated from other materials including, but not limited to, metals, wood, and glass without departing from the spirit of the invention.

Figure 1:
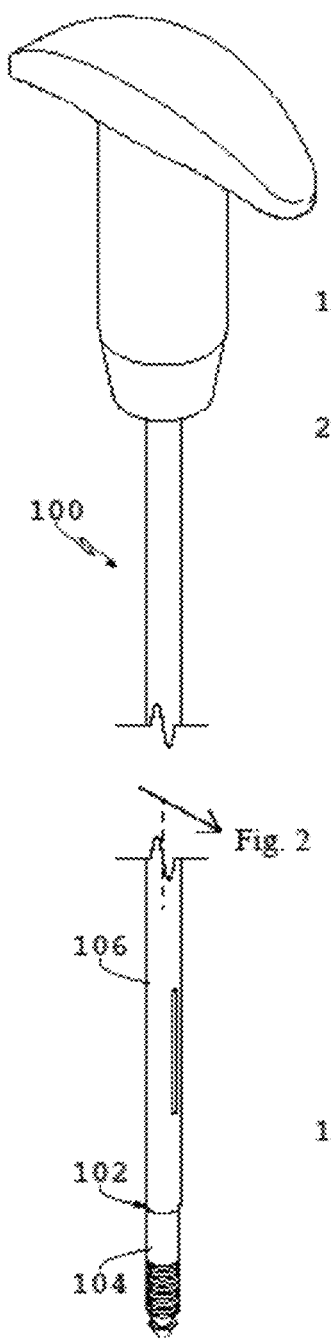
FIG. 1 is a perspective view illustration of an embodiment of the invention applied to a cleaning rod and cleaning device interface.
Figure 2:
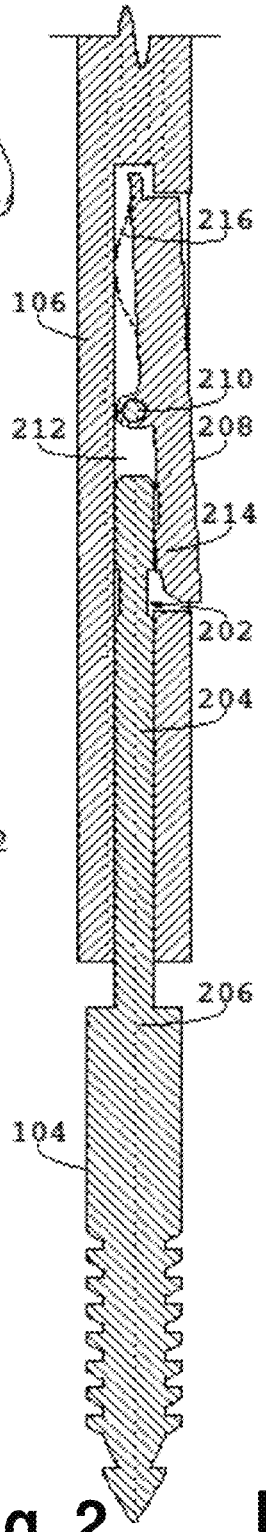
FIG. 2 is a cutaway view of an embodiment of the invention showing the cleaning rod and cleaning device interface partially engaged.

FIG. 1 illustrates, in a perspective view, a barrel cleaning tool 100 configured with an embodiment of the invention. As is illustrated at 102, a barrel cleaning device 104 is secured to a cleaning rod portion 106 of the cleaning tool 100. This cleaning rod portion 106 may be fabricated from a rigid material but may also be fabricated from a flexible material. Examples of such a flexible material may be, but are not limited to, flexible plastic or a cable material. FIG. 2 illustrates a cutaway view of a portion of the barrel cleaning device 104 showing an engagement groove 202, a first shaft portion 204, and a second shaft portion 206. As illustrated, the barrel cleaning device 104 is partially inserted into an axial recess 212 of the cleaning rod portion 106 of the barrel cleaning tool 100. A hinged latch 208 located in a recess formed in the cleaning rod portion 106 of the cleaning tool 100 is illustrated in a partially raised position. The hinged latch 208 may be affixed to the cleaning rod 106 using a pivot pin 210 or similar shape. As is illustrated in the figure, as the barrel cleaning device 104 is being inserted into an axial recess portion 212 of the cleaning rod 106, the leading edge of the hinged latch 214 may rest against the first shaft portion 204 of the barrel cleaning device 104. As is shown, a spring 216 may be used to cause the leading edge of the hinged latch 214 to be pressed against the first shaft portion 204 of the barrel cleaning device 104. Although the spring 216 is illustrated as a ribbon shape, such a spring may also be a coil shape or a flexible material anchored such as to apply pressure against the hinged latch 208. In addition to or in place of the springs described, embodiments of the invention may employ material such as, but not limited to, rubber, latex, or other compressible material to apply pressure to the hinged latch 208.

Figure 3:
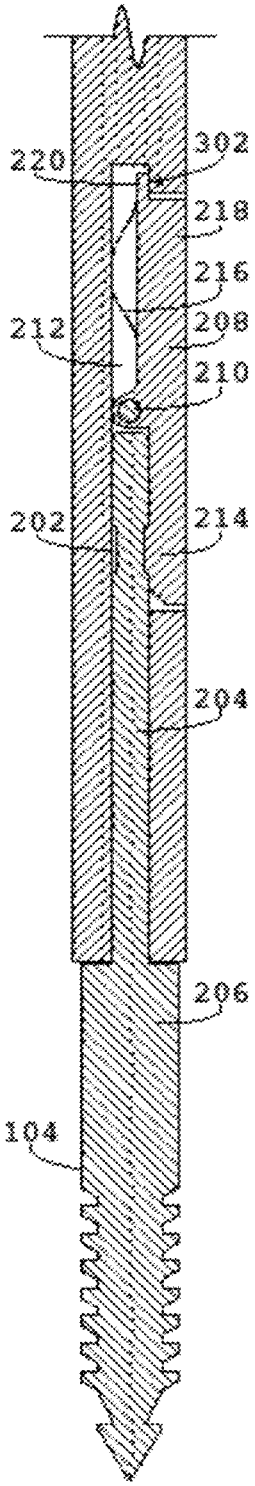
FIG. 3 is a cutaway view of an embodiment of the invention showing the cleaning rod and cleaning device interface fully engaged.

As illustrated in FIG. 3, as the first shaft portion 204 of the barrel cleaning device 104 is fully inserted into a hollow shaft portion 212 of the shaft 106 of the cleaning tool 100, the second shaft portion 206 of the barrel cleaning device 104 may come into contact with the end of the cleaning rod 106. At about the same time, the leading edge of the hinged latch 214 may be pressed into the engagement groove 202 formed in the first shaft portion 204 of the cleaning device 104 by the spring 216. As a result, the cleaning device 104 may become firmly affixed to the end of the shaft 106 of the barrel cleaning tool 100. To remove the cleaning device 104 from the end of the shaft 106, a user may apply pressure to the trailing end 218 of the hinged latch 208. Such pressure may compress the spring 216 and cause the hinged latch 208 to pivot about the pivot pin 210 which in turn, causes the leading edge 214 of the hinged latch 208 to lift out of the engagement groove 202, releasing the cleaning device 104 from the barrel cleaning tool 100.

In order to keep the hinged latch 208 from protruding beyond the outer diameter of the cleaning rod 106, a narrow ledge 220 may be formed in the trailing edge of the pivot latch 208. This narrow latch may be positioned such that it comes to rest against an inner surface of the hollow shaft portion 212 such that it prevents the trailing edge of the pivot latch 208 from being forced beyond the outer surface of the cleaning rod 106 by the spring 216. This is illustrated in FIG. 3 at 302.

A plurality of different cleaning devices may be connected to a cleaning rod 106 or cable using the engagement ridge and engagement latch arrangement described above. The cleaning device 104 shown is exemplary and it is not intended to represent the only such device that may be used in embodiments of the invention. Many other types of cleaning devices may be used, examples of which may include, but are not limited to, cleaning cloth loops, brushes, scrapers, and swabs. Additional embodiments of the invention may comprise a cleaning device interface that includes a first shaft portion 204, a second shaft portion 206, and an engagement groove 202 and that also comprises a threaded opening to allow for the attachment of threaded cleaning devices such that the convenience afforded to a user of the invention may be extended to other types of cleaning devices.

Figure 4:
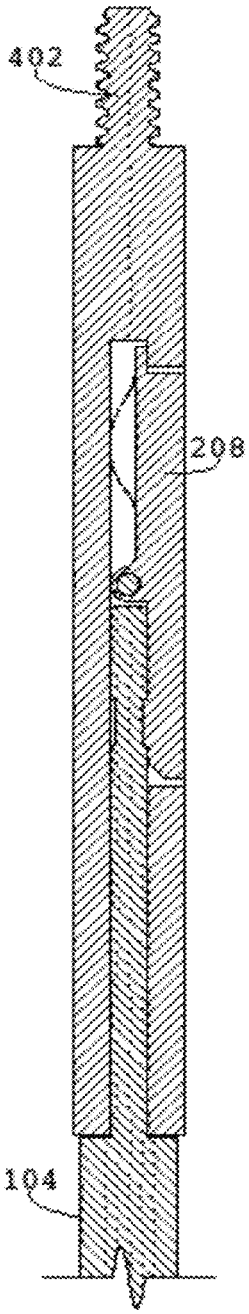
FIG. 4 is a cutaway view of an embodiment of the invention comprising an adapter for a threaded cleaning rod adapter illustrating a cleaning device fully engaged with an embodiment of the cleaning device interface.

In addition to the embodiments described above and illustrated in FIGS. 1, 2 and 3, an embodiment of the invention may also be comprised of an adapter design intended to be affixed to gun barrel cleaning tools which are configured with less convenient cleaning device attachment methods, an example of which may be a threaded connection. Other attachment methods may include, but are not limited to, press-fit, crimping, and adhesive. Such an adapter may comprise a first end with an attachment interface portion and a second end with a recess and pivot latch as described previously. An example of such an embodiment is illustrated in FIG. 4. As is shown, a threaded portion 402 may be provided to attach the adapter to a threaded gun cleaning rod. Other embodiments may replace the threaded portion with an appropriate shape depending upon the attachment method employed. Once attached, a user may change cleaning devices 104 by pressing the pivot latch 208 and removing or installing the cleaning device 104 as described earlier.

To conduct a gun barrel cleaning operation, a user may perform the described twisting motion to attach and remove cleaning devices without having to repeatedly twist to attach and detach cleaning devices as is the case when using known threaded attachment methods. In addition to attachment of cleaning devices, the invention may be applied to connect additional sections of barrel cleaning rods to accommodate longer barrels.

Figure 5A:
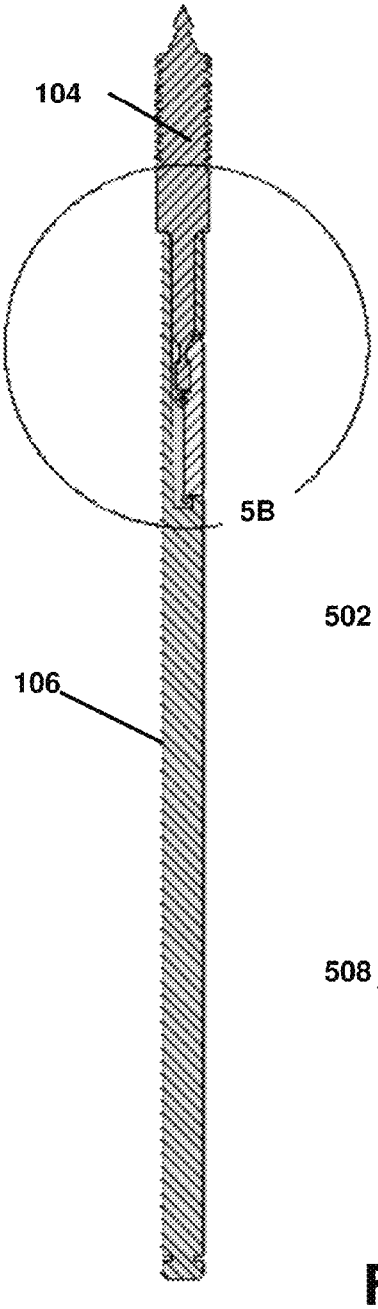
FIGS. 5A-5C illustrate a cross section view of an embodiment of the invention showing the cleaning device to hinged latch connection.
Figure 5B:
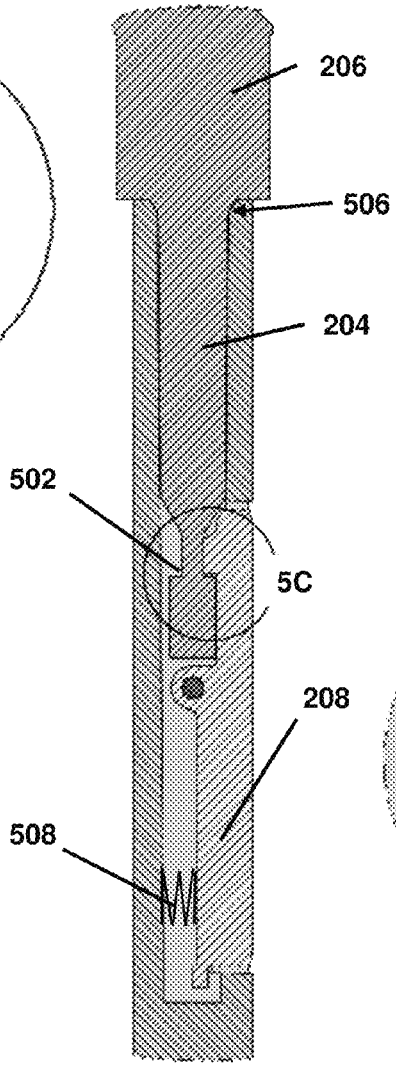
Figure 5C:
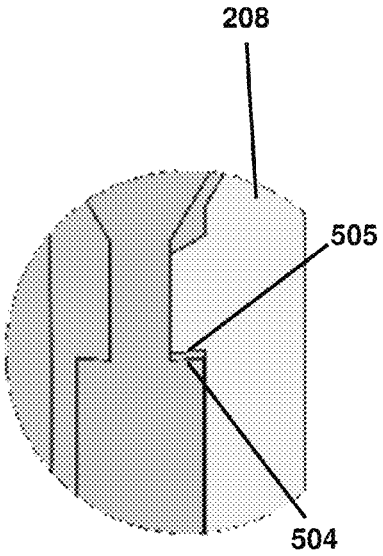

In addition to the features described above, embodiments of the present invention may be formed from a fiber reinforced plastic material. Such materials may result in a cleaning device that is less likely to damage a gun barrel, may be less susceptible to rust or corrosion, and may be less costly to produce as the result of efficient molding processes. Referring to FIG. 5A, a barrel cleaning device 104 is illustrated affixed to a cleaning rod portion 106. As was noted above, a hinged latch 208 may be positioned to engage an engagement groove 502. Referring to FIG. 5C, which illustrates the hinged latch 208 in the engagement groove 502, an inward or back bevel 504 may be formed at the point where the engagement groove 502 is in contact with the hinged latch 208. As is illustrated, in a preferred embodiment, a corresponding bevel 505 may be formed in the hinged latch 208 in order to more fully secure the cleaning device 104. Such a bevel arrangement may result in the hinged latch 208 being drawn more tightly against the engagement groove 502 as a pulling force is exerted against the cleaning device. As will be described in more detain herein, the first shaft portion 204 of the cleaning device 104 may be formed so as to be rectangular in cross section. In such a configuration, the engagement groove may be formed in two opposite sides of the cleaning tool. Because of the inward bevel shape, this arrangement of two opposing engagement grooves will permit the cleaning device to be removable from a mold without requiring an unduly complex mold. In certain embodiments the rectangular shape of the first shaft portion may have equal or nearly equal sides (forming a square) while in other embodiments, the rectangular shape may have two sides that are shorter. In such an embodiment, the cleaning device will only fit into the rod in two orientations while an embodiment that is square will fit in four orientations.

Figure 6A:
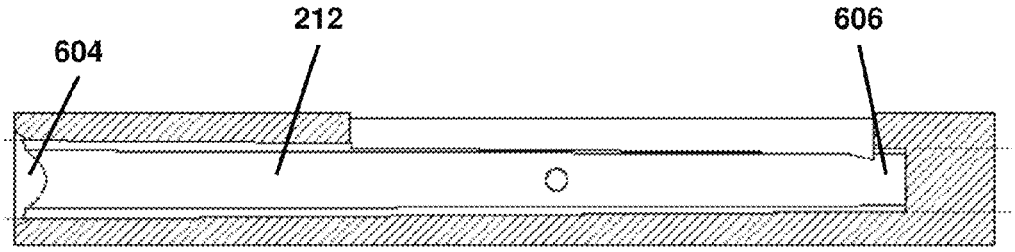
FIGS. 6A-6C are illustrations of a tapered axial recess for receiving the cleaning device in embodiments of the invention.
Figure 6B:
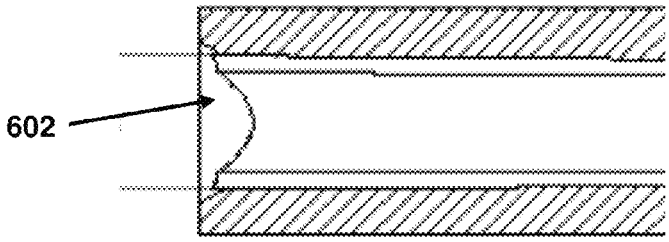
Figure 6C:
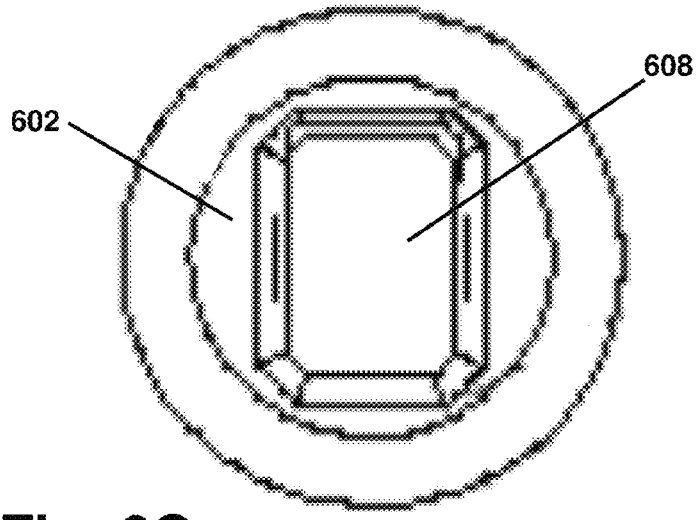

In order to increase the strength of a potential failure point at the junction of the first shaft 204 and second shaft portion 206, an arcuate shape may be formed at the transition of these two portions. An example of such a shape is illustrated at 506 of FIG. 5B. In order to allow the cleaning device to properly connect to the cleaning rod 106, the axial recess opening of the rod into which the first shaft 204 of the cleaning device is inserted may be formed with a corresponding arcuate shape. This shape is illustrated in FIGS. 6B and 6C at 602. Such a corresponding shape 602 permits the second shaft of the cleaning device 206 to rest firmly against the end of the cleaning rod 106.

Figure 7A:
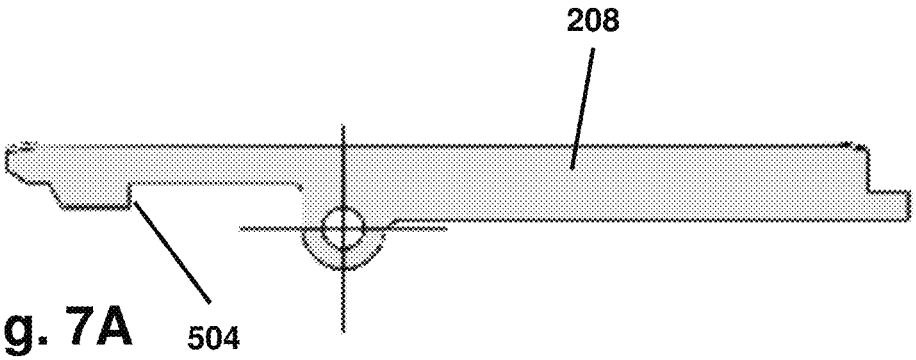
FIGS. 7A-7B illustrate a tapered hinged latch used in certain embodiments of the invention.
Figure 7B:
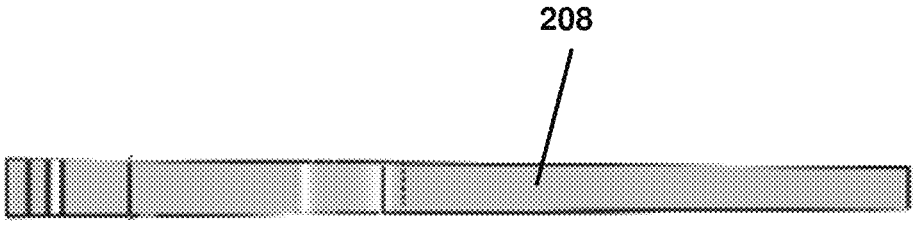

As was noted above, the first shaft 204 of the cleaning device 104 may be rectangular in cross section. This rectangular shape performs two functions, the first is to prevent the cleaning device from rotating in relation to the cleaning rod and second, the rectangular shape serves to orient the shaft such that one of the two engagement grooves (which are located on opposite sides of the cleaning device 104) aligns with the hinged latch 208 to secure the cleaning device. The rectangular shaft 204 is also tapered from the point at which the first shaft connects to the second shaft portion of the cleaning device 104 to the end of the shaft. This taper serves to more securely connect the cleaning device into the axial recess 212 of the cleaning tool 100. A cross section of the axial recess 212 is illustrated in FIG. 6A. As can be observed, the opening end 604 of the axial recess 212 is slightly larger than the closed end 606. This results in a taper from the opening end to the closed end of the axial recess which mates with a corresponding taper found on the first shaft of the cleaning device 104. As is illustrated at 608 of FIG. 6C, this axial recess is also rectangular in cross section to mate with the rectangular first shaft portion 204 of the cleaning device. As was discussed earlier herein, the hinged latch 208 is disposed in an opening formed in the cleaning rod 106 such that it makes contact with the cleaning device. An illustration of the hinged latch in position is shown in FIG. 5B. As was noted above, the axial recess tapers from an open end to a closed end. To permit the hinged latch to make contact with the cleaning device without contacting the walls of the recess in such a tapered axial recess, an embodiment of the hinged latch 208 may also be tapered. Also illustrated is a spring 508 which applies pressure to the hinged latch 208 to hold it in place against the rectangular first shaft portion 204 of the cleaning device 104. FIG. 7A illustrates a side view of the hinged latch showing the inward bevel 504 described above. As may be observed in FIG. 7B, the hinged latch 208 is also tapered from the inward bevel end of the latch to the portion of the hinged latch that is positioned near the closed end of the axial recess. This taper of the hinged latch serves to prevent the hinged latch from binding with the tapered portion of the axial opening when the latch is depressed to release the cleaning device.

Figure 8:
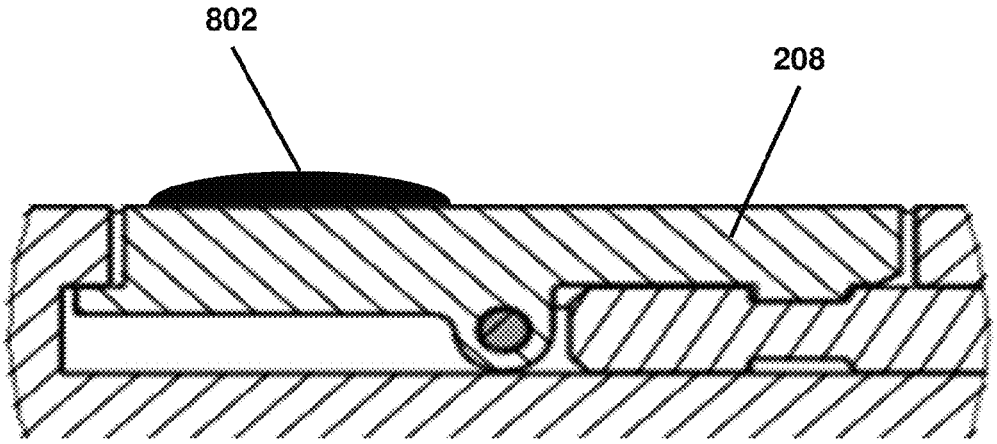
FIG. 8 illustrates a raised portion of a hinged latch used in certain embodiments of the invention to allow a user to more easily depress the hinged latch to release the cleaning device from the cleaning rod.

In addition to the tapered latch, a raised portion may be formed on an outer portion of the hinged latch as illustrated FIG. 8 at 802. This raised portion permits a user to more easily depress the hinged latch 208 in order to release the cleaning device.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A system for cleaning debris from a tubular barrel assembly comprised of:

a barrel cleaning tool comprising a cleaning rod portion;

a rectangular recess formed in one end of the cleaning rod, the recess tapering from the end of the cleaning rod to the end of the recess;

an opening formed in the outer surface of the cleaning rod portion where the opening is in communication with the recess and tapered to align with the inner walls of the recess;

a latch device located within the opening where a leading end of the latch device has a protrusion extending inwardly toward the recess, the protrusion configured with an angle of less than 90 degrees from a face of the protrusion to the surface of the latch device;

a barrel cleaning device with an elongated rectangular and tapered shaft where the shaft is sized such that it is insertable into the recess; and a receiving recess portion located on the shaft with a wall having a surface angle corresponding to that of the protrusion of the latch device, the wall configured to engage the protrusion of the latch device when the shaft is inserted into the rectangular recess of the cleaning rod.

2. The system of claim 1, wherein the latch device is tapered in a manner corresponding to the rectangular recess.

3. The system of claim 1, wherein the latch device is a hinged latch device which pivots about a pivot pin which extends through the hinged latch device and at least partially into interior walls of the recess formed in the cleaning rod.

4. The system of claim 3, additionally comprising a spring which acts upon the hinged latch device.

5. The system of claim 3, wherein the hinged latch device comprises a raised portion which protrudes beyond the outer surface of the cleaning rod.

6. The system of claim 1, wherein the elongated rectangular shaft of the barrel cleaning device is thicker than it is wide.

7. The system of claim 6, wherein the receiving recess portion is positioned on two opposing faces of the cleaning device shaft.

8. The system of claim 1, wherein the elongated shaft of the barrel cleaning devices comprises at least two cross-sectional shapes, a first cross-section shape being rectangular and sized to be insertable into the cleaning rod recess and a second cross-section shape being cylindrical with a diameter that is larger than the cleaning rod recess.

9. The system of claim 1, wherein the barrel cleaning device which also comprises a cylindrical portion affixed to the elongated rectangular and tapered shaft where the point at which the elongated rectangular and tapered shaft is affixed to the cylindrical portion comprises a convex arcuate shape beginning at the cylindrical portion and ending at the elongated rectangular shaft.

10. An adapter for use with a barrel cleaning tool comprising:

a cylindrical rod portion wherein the rod portion comprises an attachment interface to a cleaning tool at a first end of the rod and a rectangular recess formed at a second end, the recess tapering from the end of the cleaning rod to the end of the recess;

an opening formed in the outer surface of the rod portion where the opening is in communication with the recess and tapered to align with the inner walls of the recess;

a latch device located within the opening where a leading end of the latch device has a protrusion extending inwardly toward the recess, the protrusion configured with an angle of less than 90 degrees from a face of the protrusion to the surface of the latch device;

a barrel cleaning device with an elongated rectangular and tapered shaft where the shaft is sized such that it is insertable into the recess; and a receiving recess portion located on the shaft with a wall having a surface angle corresponding to that of the protrusion of the latch device, the wall configured to engage the protrusion of the latch device when the shaft is inserted into the rectangular recess of the cleaning rod.

11. The adapter of claim 10, wherein the latch device is tapered in a manner corresponding to the rectangular recess.

12. The adapter of claim 11, wherein the latch device is a hinged latch device additionally comprising a spring which acts upon the hinged latch device.

13. The adapter of claim 10, wherein the elongated rectangular shaft of the barrel cleaning device is thicker than it is wide.

14. The adapter of claim 13, wherein the receiving recess portion is positioned on two opposing faces of the cleaning device shaft.

15. The adapter of claim 10, wherein the elongated shaft of the barrel cleaning devices comprises at least two cross-sectional shapes, a first cross-section shape being rectangular and sized to be insertable into the cleaning rod recess and a second cross-section shape being cylindrical with a diameter that is larger than the cleaning rod recess.

16. The adapter of claim 10, wherein the barrel cleaning device which also comprises a cylindrical portion affixed to the elongated rectangular and tapered shaft where the point at which the elongated rectangular and tapered shaft is affixed to the cylindrical portion comprises a convex arcuate shape beginning at the cylindrical portion and ending at the elongated rectangular shaft.

17. The adapter of claim 10, wherein the latch device comprises a raised portion which protrudes beyond the outer surface of the cleaning rod.

18. A system for cleaning debris from a tubular barrel assembly comprised of:

a barrel cleaning tool comprising a cleaning rod portion;

a rectangular recess formed in one end of the cleaning rod, the recess tapering from the end of the cleaning rod to the end of the recess;

an opening formed in the outer surface of the cleaning rod portion where the opening is in communication with the recess and tapered to align with the inner walls of the recess;

a hinged latch device which pivots about a pivot pin located within the opening where a leading end of the latch device has a protrusion extending inwardly toward the recess, the protrusion configured with an angle of less than 90 degrees from a face of the protrusion to the surface of the latch device;

a spring which acts upon the hinged latch device;

a barrel cleaning device with an elongated rectangular and tapered shaft and a cylindrical portion affixed to the elongated rectangular and tapered shaft, where the elongated rectangular and tapered shaft is sized such that it is insertable into the recess and the cylindrical portion has a diameter sized such that is it larger than the cleaning rod recess where the point at which the elongated rectangular and tapered shaft is affixed to the cylindrical portion comprises a convex arcuate shape beginning at the cylindrical portion and ending at the elongated rectangular shaft; and a receiving recess portion located on the shaft with a wall having a surface angle corresponding to that of the protrusion of the latch device, the wall configured to engage the protrusion of the latch device when the shaft is inserted into the rectangular recess of the cleaning rod.

* * * * *